United States Patent [19]

Versteeg

[11] Patent Number: 4,575,984

[45] Date of Patent: Mar. 18, 1986

[54] CONSTRUCTION ELEMENT

[75] Inventor: Gijsbert Versteeg, Nunspeet, Netherlands

[73] Assignee: IMEX AG, Zurich, Switzerland

[21] Appl. No.: 502,744

[22] Filed: Jun. 9, 1983

[30] Foreign Application Priority Data

Jun. 16, 1982 [NL] Netherlands ..... 8202430

[51] Int. Cl.[4] ..... E04C 1/10; E04C 1/30

[52] U.S. Cl. ..... 52/589; 52/588; 52/583; 52/601

[58] Field of Search ..... 52/589, 601, 583, 588

[56] References Cited

U.S. PATENT DOCUMENTS

| | | | |
|---|---|---|---|
| 458,448 | 8/1891 | Ewing | 52/589 |
| 999,509 | 8/1911 | Lydon | 52/589 |
| 1,212,327 | 1/1917 | Cory | 52/589 |
| 1,916,620 | 7/1933 | Johnson | 52/589 |
| 2,021,922 | 11/1935 | Peck | 52/601 |
| 2,103,894 | 12/1937 | Bassmann | 52/583 |
| 2,115,936 | 5/1938 | Sterns | 52/601 |
| 2,142,305 | 1/1939 | Davis | 52/589 |
| 2,181,451 | 11/1939 | Dow | 52/589 |
| 2,338,246 | 1/1944 | Hoge | 52/601 |
| 2,748,591 | 6/1956 | Brown | 52/583 |
| 2,920,475 | 1/1960 | Graham | 52/583 |

FOREIGN PATENT DOCUMENTS

| | | | |
|---|---|---|---|
| 560043 | 9/1932 | Fed. Rep. of Germany . | |
| 2106670 | 8/1972 | Fed. Rep. of Germany . | |
| 2616317 | 3/1977 | Fed. Rep. of Germany . | |
| 842637 | 3/1939 | France . | |
| 2158020 | 8/1973 | France . | |
| 488984 | 1/1954 | Italy | 52/589 |
| 75682 | 8/1954 | Netherlands . | |
| 106948 | 12/1923 | Switzerland . | |
| 253602 | 3/1925 | United Kingdom . | |

*Primary Examiner*—Donald G. Kelly
*Assistant Examiner*—Michael Safavi
*Attorney, Agent, or Firm*—Pahl, Lorusso & Loud

[57] ABSTRACT

A construction element for constructing a supporting floor or the like consists of a slab made of reinforced concrete. The side walls of the slab are provided with protection profiles connected with each other. Two series of aligned, alternating projections and complementary recesses are lying above each other on each side wall of the slab, wherein the projections of one of the series are staggered with respect to the projections of the other series in such a manner that the recesses of one of the series lie above respectively below the projections of the other series. The projections of the lower series lie at a distance from the lower surface of the slab. As the construction elements forming a supporting floor are connected with each other by the interlocking projections and recesses of the adjacent side walls, the load of a construction element is distributed over the adjacent construction elements so that each construction element can take up a very high load.

8 Claims, 3 Drawing Figures

CONSTRUCTION ELEMENT

The invention relates to a construction element for constructing a supporting floor or the like, consisting of a slab made of reinforced concrete.

Such a construction element can be used for different purposes, wherein a supporting floor suited for high loads should be formed on an underground with low load taking capacity, such as for example for making a road surface in a quarter with newly built houses or for repairing a runway destroyed by bomb-craters. To this end, the known construction elements are placed on the underground with their flat side walls contacting each other until the desired floor surface is covered. As there are no connections between the different construction elements, the construction elements will sag and/or shift with respect to each other, which especially applies for the construction elements lying at the circumference of the floor surface formed. This causes an irregular surface after some time, which is very disadvantageous.

The invention aims to provide a construction element of the above-mentioned kind, wherein this disadvantage is obviated in a simple but nevertheless effective way.

To this end, the construction element according to the invention is characterized in that the side walls of the slab each are provided with a plurality of aligned, alternating projections and complementary recesses.

In this manner it is obtained that the construction elements are connected with each other by the interlocking projections and recesses of the adjacent side walls so that the load of a construction element is distributed over the adjacent construction elements. Thereby, each construction element can take up a very high load without causing the construction element to sag. Therefore, the construction element according to the invention is especially suitable for repairing runways and the like, wherein high impact loads may occur.

According to a favourable embodiment of the invention two series of projections and complementary recesses lying above each other are formed on each side wall of the slab, wherein the projections of one of the series are staggered with respect to the projections of the other series in such a a manner that the recesses of the upper series lie above the projections of the lower series and the recesses of the lower series lie below the projections of the upper series.

According to the invention the bottom wall of each recess is flush with the corresponding side wall of the slab.

Preferably, the projections of the lower series lie at a distance from the lower surface of the slab in this case. In this manner it is obtained that beneath the projections of the adjacent side walls of two construction elements, a space remains free between these adjacent side walls, in which space any material of the underground driven up when the construction elements are placed against each other, can be received so that the construction elements placed against each other form a substantially closed floor surface.

According to the invention the upper surface of the projections of the upper series are flush with the upper surface of the slab, wherein preferably the projections comprise end faces at their longitudinal ends, said end faces enclosing an angle of approximately 45° with the corresponding side wall of the slab, wherein the length of the outer end of each projection directed away from the slab is substantially equal to the length of each recess at the bottom wall thereof. Thereby it is obtained that a perfectly flat and completely closed floor surface can be made.

According to the invention a corner plate is mounted in each corner formed by two protection profiles joining each other, a hole being formed in each corner plate. In this manner a construction element can be pulled against the construction elements already assembled in the floor surface by means of a simple auxiliary tool which consists of a lever rod with a chain fixed thereto, wherein the construction element is somewhat lifted from the underground so that driving up the underground is restricted to a minimum.

The invention will now be further explained by reference to the drawings in which two embodiments of the construction element according to the invention are shown.

Figure 1:
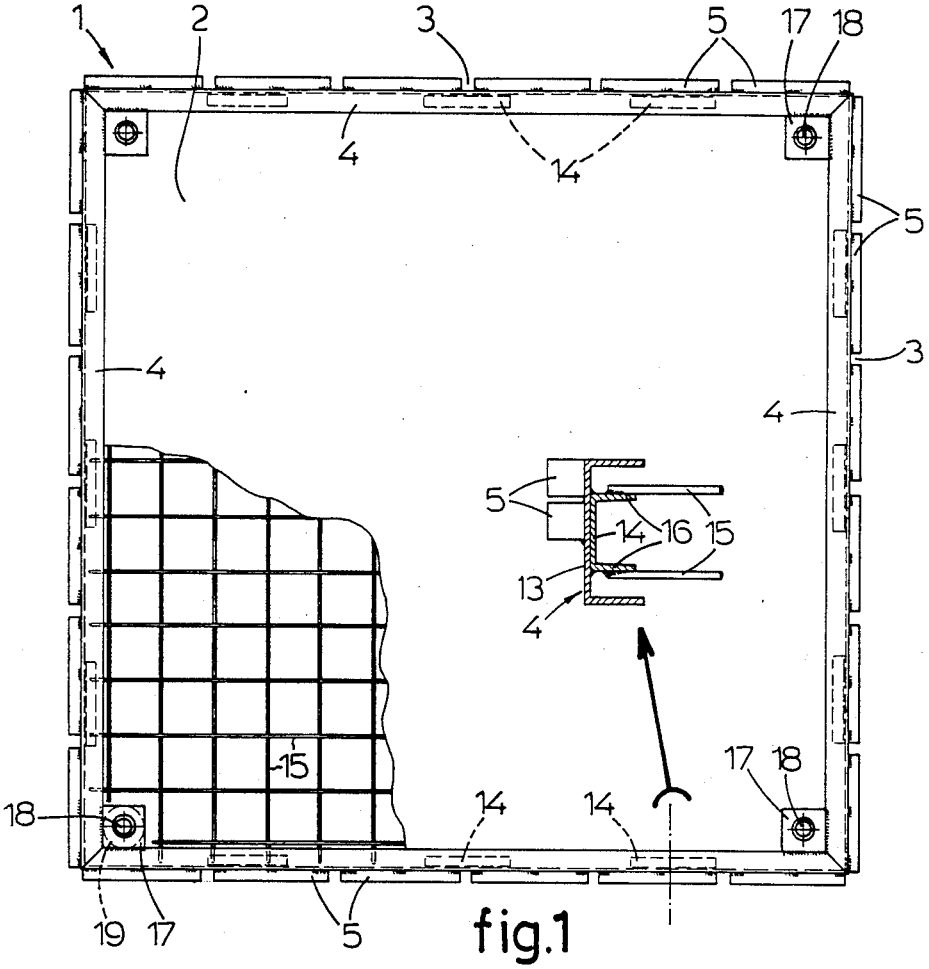
FIG. 1 is a top view of an embodiment of the construction element according to the invention, wherein the concrete is partially broken away and, further, one of the side walls is shown in cross-section.

Referring to FIG. 1, there is shown a top view of a construction element 1 consisting of a slab 2 made of reinforced concrete. The side walls 3 of the slab 2 are provided with protection profiles 4 connected with each other at their ends. The protection profiles 4 each are formed as a U-section at the embodiment shown, as appears from the cross-section of a side wall 3 also shown in FIG. 1.

Figure 2:
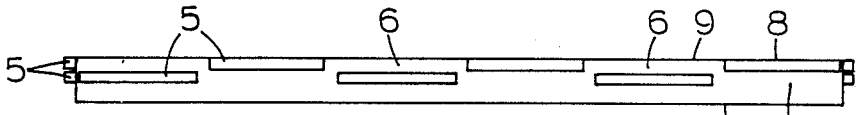
FIG. 2 is a side view of the construction element FIG. 1.

On each side wall of the slab 2 two series of aligned, alternating projections 5 and complementary recesses 6 are formed as shown in the side view of FIG. 2. The projections 5 of and recesses (6) of the upper series are staggered with respect to the projections 5 and recesses (6) of the lower series in such a manner that the recesses 6 of the upper series lie above the projections of the lower series and such that the projections (5) of the upper series lie above the recesses (6) of the lower series. The bottom wall of each recess 6 is formed by the corresponding side wall 3. The projections 5 of the lower series lie at a distance of the lower surface 7 of the slab 2. Thereby, a space remains free under the projections 5 between the adjacent side walls 3 of two construction elements 1 placed against each other, in which space any material of the underground driven up can be received so that this material can not impede that the construction elements 1 are placed against each other completely.

Figure 3:
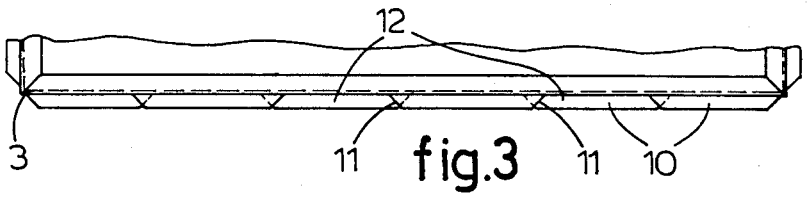
FIG. 3 is a partially shown top view of an alternative embodiment of the construction element according to the invention.

The upper surface 8 of the projections 5 of the upper series is flush with the upper surface 9 of the slab 2 so that the upper surface 8 of these projections 5 forms part of the floor surface formed by a number of construction elements. At the embodiment according to FIG, 1 and 2, the length of each recess 6 is greater than the length of a projection 5 plus twice the thickness of the projection 5. Thereby, no problems can occur when a number of slabs are moved against each other into a desired floor surface. As an alternative, projections 10 can be formed on the side walls 3 of a slab 2, which projections 10 comprise end faces 11 at their longitudinal ends, which end faces 11 enclose an angle of approximately 45° with the corresponding side wall 3 of the slab 2. The length of the outer end of each projection 10 directed away from the slab 2 is substantially equal to the length of each recess 12 at the bottom wall thereof formed by the side wall 3 (see FIG. 3). Thereby, a completely closed floor surface is obtained.

The construction element 1 described is especially suited for making a supporting floor which has to take up very high loads, on an underground with low load taking capacity. As the construction elements 1 are coupled with each other by the interlocking projections 5, 10 and recesses 6, 12, wherein the projections 5, 10 of the series lying above each other, support each other, the load of each construction element 1 is distributed over the adjacent construction elements of the floor surface. Thereby, each construction element 1 can take up a very high load without causing the construction element 1 to sag or shift, so that it is guaranteed that the floor surface remains flat and closed.

It is noted that instead of two series of projections and recesses the slab 2 at its side walls 3 can be provided with one series of projections and recesses, wherein the recesses are formed as holes in the side walls 3.

As already noted, the projection profiles 4 each consist of a U-section, the webs 13 of the U-sections forming the side walls 3 of the slab 2. The massive made projections 5 are fixed on the web 13 of each protection profile 4, for example by means of a welded connection. A plurality of U-sections 14 are fixed on the inner side of each protection profile 4, said U-sections 14 being short and having a height less than the height of the protection profile 4. These U-sections 14 serve as support for the reinforcement 15 of the concrete of the slab 2. The reinforcement 15 consists in this case of two steel wire mats fixed on the legs 16 of the U-sections 14 by a welded connection. As an alternative, each protection profile 4 with the corresponding projections 5, 10 can be manufactured in one piece from a flat metal band by rolling and/or pressing. In this case the connection elements for the reinforcement 15 can be formed in this one piece unit, if desired.

As appears from the top view of FIG. 1, in each corner of the slab a corner plate 17 is fixed to the protection profiles 4 joining each other in the respective corner. A hole 18 is formed in each corner plate 17, which hole can pass completely through the slap 2, if desired. To this end, a tube 19 indicated by a dashed line can be mounted in each corner of the slab 2, said tube contacting a corresponding corner plate 17 lying at the lower side of the slab 2. Thereby, the construction element can be brought in the desired position in the floor surface to be formed by means of a simple auxiliary tool (not shown in the drawings). This auxiliary tool consists of a lever rod which is placed in the hole 18 of a corner plate 17 of a construction element 1 already assembled into the floor surface, a chain being fixed to the lever rod, which chain can be fixed in the hole 18 of a corner plate 17 of the construction element 1 which has to be brought into the floor surface. By pulling the lever rod backwards, the construction element is pulled to the floor surface already formed, wherein the construction element 1 is somewhat lifted from the underground so that driving up material of the underground is restricted to a minimum.

Although a square construction element 1 is shown in the drawings, the construction element according to the invention may have any suitable form, for example the form of a rectangle, a hexagon, an octagon or a triangle and the like. It will be clear that for example with a rectangular construction element and a triangular construction element any desired floor surface can be made.

The invention is not restricted to the above described embodiments which can be varied in a number of ways within the scope of the invention.

For example, it is possible to omit the protection profiles and to manufacture the projections in one piece with the concrete slab, wherein the recesses can be formed as holes in the side walls 3 or by manufacturing two staggered series of projections above each other as described.

I claim:

1. Construction element for constructing a supporting floor or the like, comprising a slab made of reinforced concrete having an upper and a lower surface, each of the side walls of the slab being provided with an upper and lower series of aligned, alternating projections and complementary recesses, each projection having an upper and a lower surface, the bottom wall of each recess being flush with the corresponding side wall of the slab, wherein the recesses of the upper series lie above the projections of the lower series, wherein the recesses of the lower series lie below the projections of the upper series and, wherein the recesses and projections of the lower series lie at a distance from the lower surface of the slab, and wherein the side walls of the slab are provided with protection profiles connected with each other, the projections being carried by the protection profiles and wherein a corner plate is mounted in each corner formed by two of said protection profiles joining each other, a hole being formed in each corner plate.

2. Construction element according to claim 1 wherein the upper surface of the projections of the upper series are flush with the upper surface of the slab.

3. Construction element according to claim 1 wherein the length of a projection is smaller than the length of a recess.

4. Construction element according to claim 1 wherein the projections comprise end faces at their longitudinal ends, said end faces enclosing an angle of approximately 45° with the corresponding side wall of the slab, wherein the length of the outer end of each projection directed away from the slat is substantially equal to the length of each recess at the bottom wall thereof.

5. Construction element according to claim 1 wherein the protection profiles consist of U-sections, the webs of which form the side walls of the slab, the massive projections being fixed on these webs.

6. Construction element according to claim 1 wherein each protection profile with the corresponding projections is made in one piece.

7. Construction element according to claim 1 wherein the reinforcement of the concrete is connected with the protection profiles.

8. Construction element according to claim 7, wherein at least one short U-section with a lower height than the protection profile is fixed on the inner side of each protection profile for supporting the reinforcement of the concrete.

* * * * *